US005554056A

United States Patent [19]

Henricus op ten Berg

[11] Patent Number: 5,554,056

[45] Date of Patent: Sep. 10, 1996

[54] LOW INSERTION FORCE RECEPTACLE TERMINAL

[75] Inventor: Roy Henricus op ten Berg, Oss, Netherlands

[73] Assignee: The Whitaker Corporation, Wilmington, Del.

[21] Appl. No.: 344,907

[22] Filed: Nov. 25, 1994

[30] Foreign Application Priority Data

Dec. 2, 1993 [GB] United Kingdom ..... 9324762

[51] Int. Cl.[6] ..... H01R 4/48

[52] U.S. Cl. ..... 439/857; 439/851

[58] Field of Search ..... 439/851, 852, 439/843, 856, 857

[56] References Cited

U.S. PATENT DOCUMENTS

| | | | |
|---|---|---|---|
| 3,963,302 | 6/1976 | Gourley | 439/851 |
| 4,795,379 | 1/1989 | Sasaki et al. | 439/856 |
| 4,874,338 | 10/1989 | Bakermans | 439/851 |
| 5,135,417 | 8/1992 | Stanevich | 439/851 |
| 5,145,422 | 8/1992 | Fry | 439/856 |
| 5,160,283 | 10/1992 | Fry et al. | 439/752 |

FOREIGN PATENT DOCUMENTS

| | | |
|---|---|---|
| 0527399A1 | 2/1993 | European Pat. Off. . |
| 1018909 | 2/1966 | United Kingdom . |
| WO86/02206 | 4/1986 | WIPO . |

*Primary Examiner*—David L. Pirlot
*Assistant Examiner*—Brian J. Biggi

[57] ABSTRACT

An electrical receptacle terminal comprises a wire connection section, a rectangular body section and a pair of cantilever beam contacts extending therefrom. Insertion of a male tab between the cantilever beams initially prises the beams resiliently apart whilst passing first protrusions at a forward end of the terminal, and then further biases apart the cantilever beams when inserted between second contact dimples axially rearwards of the first protrusions. Electrical contact is finally made between the contact dimples and the male tab, which due to the short lever arm and the point contact, has a high contact pressure thereby ensuring good electrical conductivity therebetween. Certain applications may require lower currents, and the insertion force can be further reduced by providing cutouts in the terminal body section to make the resilient cantilever beams more supple. The latter can be done without designing new connector housings or a new terminal, and requires only a small change in the stamping process, which provides for a cost-effective solution.

10 Claims, 2 Drawing Sheets

LOW INSERTION FORCE RECEPTACLE TERMINAL

BACKGROUND OF THE INVENTION

1. Field of the Invention

This invention relates to an electrical receptacle terminal that provides a high contact force yet results in a low insertion force during mating with a complementary male terminal.

2. Description of the Prior Art

There is a continual demand in the electrical industry to provide electrical terminals with ever increasing current carrying capability but nevertheless being cost-effective and requiring low insertion force when mated to a complimentary terminal. One of the important factors determining the current carrying capability of an electrical terminal, is the resistance of the contact between mating terminals. The contact resistance is largely influenced by the presence of metal oxide layers or dirt, which increase the resistance, and the contact pressure. In order to provide a small electrical terminal that is reliable and has increased current carrying capability, the terminal should be simple and cheap to manufacture, have an increased contact pressure, provide a means for eliminating oxide layers between contacts by a wiping action, but nevertheless having low mating forces between complementary terminals.

SUMMARY OF THE INVENTION

It is therefore an object of this invention to provide a compact electrical receptacle terminal that is cost-effective, has a high current carrying capability and is reliable.

It is a further object of this invention, to provide the aforementioned terminal, having a simple means for adjusting the mating forces without substantial modification of the design and manufacturing thereof, yet maintaining the dimensions required for mounting in identical connector housings.

The objects of this invention have been achieved by providing an electrical receptacle terminal stamped and formed from sheet metal and comprising a rectangular shape body section having top, bottom and side walls, and a pair of resilient cantilever beams extending from the side walls, each beam having a first flared protrusion proximate a complimentary male contact receiving end of the terminal for receiving a complementary male contact, and each cantilever beam also having a second contact dimple spaced axially rearwards of the first protrusion. During mating with the male contact, the cantilever beams are resiliently biased apart in a first step by insertion of the male contact between the first protrusions, and in a second step the cantilever beams are biased even further apart by further insertion of the male contact between the second contact dimples. Due to the rearward position of the second contact dimples with respect to the first protrusions, and therefore the shorter lever arm, the beams are biased with greater pressure against the male contact than the first protrusions would be. In order to reduce the insertion force of the male contact past the second contact dimples, they can be shaped in an axially extending oval manner so as to gradually move the contact point from a position far from the terminal body section to a position closer to the terminal body section thereby gradually changing the lever arm of the contact point. Further objects of this invention have been achieved by providing oblong cutouts in the top and bottom walls of the terminal body section such that the spring force of the cantilever beams can be adjusted, and therefore the mating forces, without modification of the external dimensions of the terminal. The latter enables connectors for differing applications to be made with optimum insertion forces without large expenditure.

DETAILED DESCRIPTION OF THE PREFERRED EMBODIMENT

Figure 1:
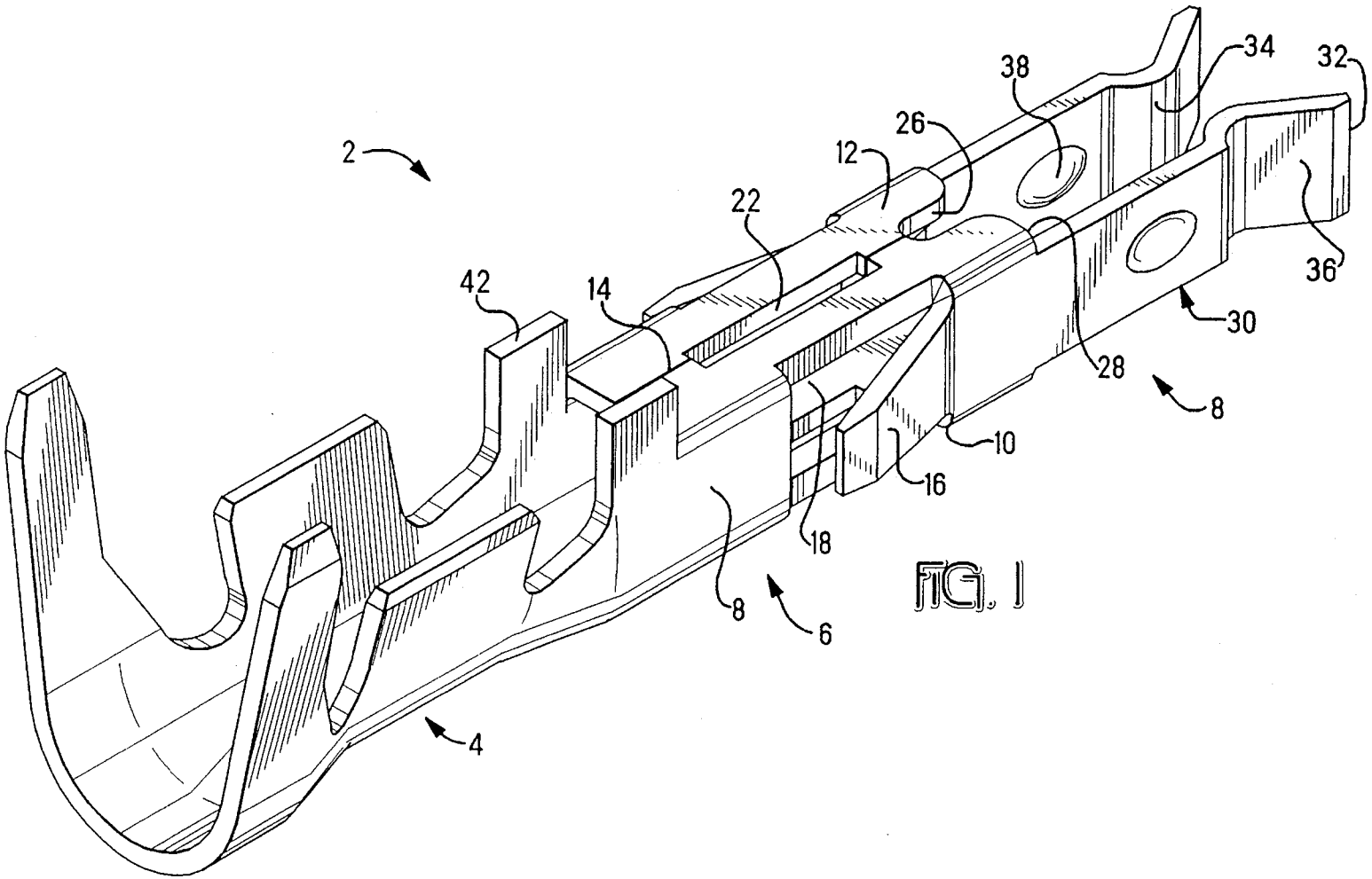
FIG. 1 is an isometric view of an electrical receptacle terminal.
Figure 2:
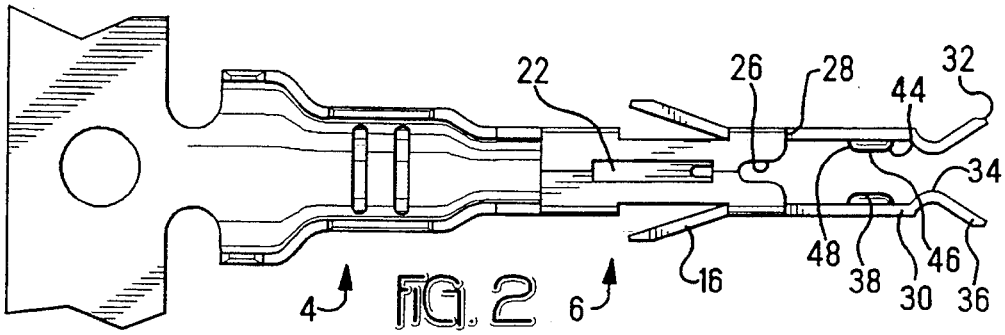
FIG. 2 is a top view of the terminal of FIG. 1.
Figure 3:
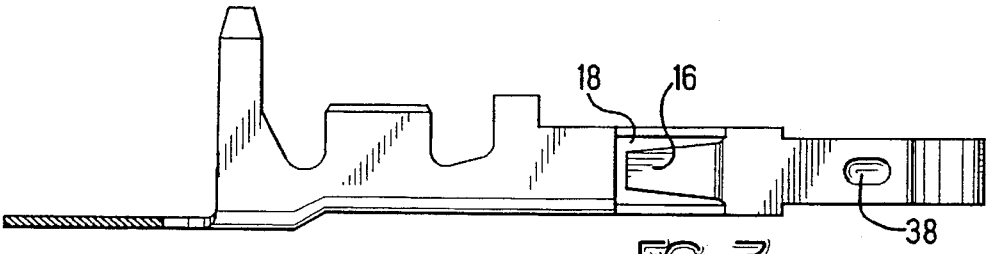
FIG. 3 is a side view of the terminal of FIG. 1.
Figure 4:
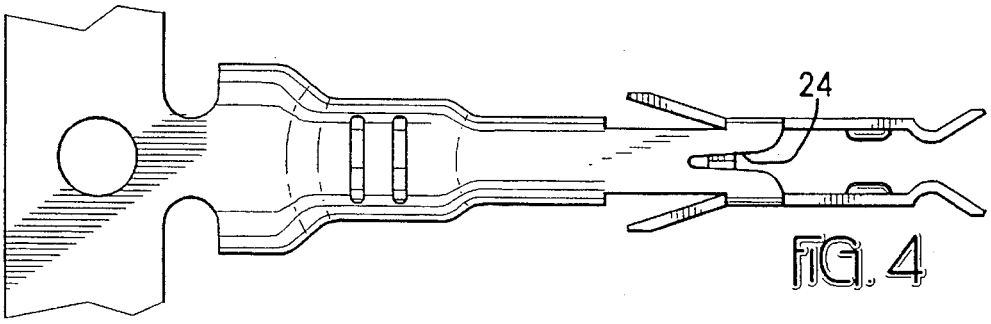
FIG. 4 is a bottom view of the terminal of Figure 1.
Figure 5:
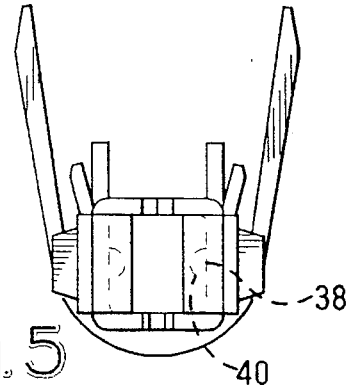
FIG. 5 is a front end view of the terminal of FIG. 3.

Referring to FIGS. 1 to 5, an electrical receptacle terminal generally shown at 2, comprises a wire connection section 4 attached to a central body section 6 from which extends a contact section 81 for mating with a complementary male pin or tab terminal (not shown). The body section 6 is a rectangular shaped body comprising a pair of opposed side walls 8, a bottom wall 10 and a top wall 12 split into two halves by a seam 14 that defines the join of the sheet metal from which the terminal 2 is stamped and formed. The body section 6 also comprises a pair of resilient locking lances 16 stamped out of the side walls 8. The side walls 8 comprise cutouts 18 resulting partially from stamping out of the locking lances 16 from the side walls 8. The top wall 12 comprises a first oblong cutout 22 disposed centrally between the side walls 8 and extending in the axial direction. The bottom and top walls comprise further cutouts 24, 26 respectively, disposed axially forwards of the cutout 22 and extending to a front edge 28 of the body section 6. The contact section 8 comprises a pair of cantilever beams 30 integral with the side walls 8 and extending from the body section front edge 28 to a complementary terminal receiving end 32.

The resilient cantilever beams 30 comprise at the forwardmost end 32, arcuate protrusions 34 spaced apart at a distance less than the thickness of the complimentary male tab or pin terminal, the arcuate contact protrusions 34 extending into outwardly flared portions 36 for guiding the complementary male terminal. The cantilever beams 30 also comprise, axially rearwards of the first protrusions 34, second contact dimples 38 that are ovally shaped with the larger axis extending in the axial direction, whereby the dimples 38 made by embossing the sheet metal. The cross-sectional profile of the dimples 38 with respect to a section perpendicular to the axial axis of the terminal, is arcuate as indicated by the dotted line 40 shown in FIG. 5.

Projecting upwards from the side walls 8 at the rearmost position of the body section 6, are positioning tabs 42 that serve to correctly position and stabilize the terminal when mounted within a cavity of an electrical connector housing (not shown).

Mating of the receptacle connector 2 and a male tab or pin terminal (not shown) will now be explained. During coupling, the male tab is directed axially between the cantilever beams 30, guided during preliminary insertion by the outwardly flared portions 36 and subsequently prising apart the beams 30 on passing the first protrusions 34. The insertion force is the greatest during the initial biasing apart of the beams 30 whilst the protrusions 34 "climb" over the forward tip of the male terminal.

The male terminal is then further inserted until the front end thereof enters into contact with the second contact dimples, which are spaced apart at a distance less than the thickness of the tab due to the beam bending line starting at the forward end 28 of the body section 6 and bending progressively outwards onto the forward most end 32. The second contact dimples 38 are therefore inclined with respect to the axial direction. The male tab thus makes contact initially with a forward most end 44 of the contact dimple 38 and progressively slides across the innermost boundary 46 of the dimple 38 thereby gradually further prising apart the cantilever beams 30. Once the tab is completely inserted past the dimple 38, contact therewith is made at the rearmost end 48. Due to the inclination of the dimple 38 and its rounded profile 40, contact with the male tab is made by a "point", resulting in very high contact pressure. The latter, in addition to the wiping effect during insertion that removes any dirt or oxide layer, results in good electrical contact therebetween.

The preferred embodiment of this invention as described above, has a low insertion force yet provides very high contact pressure because the cantilever beams 30 are initially prised apart at the forward-most end where the lever arm is long, and the force required therefore low, and contact is made with the second dimples 38 which are closer to the supporting structure of the beams 30, therefore have a shorter lever arm and apply a greater spring force on the male contact. To further reduce the insertion force, the second contact dimples 38 are shaped ovally in the axial direction so that the male tab gradually biases apart the cantilever beams 30 while passing from the dimples' forward-most end 44 to the rearmost end 48 where contact is finally made; the lever arm of the contact point therefore reducing gradually. During complete insertion of the male contact, electrical contact is therefore made completely, or almost completely by the second dimple contact points 48, whereby the first contact protrusions 34 are spaced apart from the male tab.

As the first protrusions 34 span across the width of the cantilever beams 30, they provide a preliminary wiping action on the male terminal prior to contact with the second contact dimples.

Although it would be desirable to have the highest possible contact pressure for good electrical conductivity, this also means that the insertion force will be correspondingly high. In order to further reduce the insertion force, the contact pressure could be reduced to an optimum value ensuring sufficient conductivity for the electrical current that is specified. This is obviously not always the same, depending on the application, and it is therefore possible in many cases to reduce the contact pressure, thereby further reducing the insertion force. This can be achieved without changing the terminal material or redesigning the terminal, by providing the cutouts 22, 24, 26 in the bottom and top walls and the cutouts 18 in the side walls 8. These cutouts reduce the rigidity of the structure supporting the cantilever beams 30, thereby making the beams 30 more supple. By varying the length and the width of the cutouts 18, 22, 24, 26, the resiliency of the cantilever beams 30 can be reduced to an optimum value sufficient to ensure the specified current, yet providing the lowest insertion force. The advantage of the latter is the maintenance of the terminal exterior dimensions which means that connectors for differing applications can be produced with the same connector housings and male terminals, whilst only modifying the receptacle terminals by punching different sized cutouts; the latter requiring only minor modification of the stamping tool and procedure.

Advantageously therefore, the invention as described above procures a very high contact pressure, due to: the point contact, the effective wiping action, and the high spring force; whilst maintaining the insertion force of the complementary male terminal low by providing the first protrusions 34 having a long lever arm and effectuating initial biasing apart of the contact beams thereby. The insertion force is further reduced by providing an ovally shaped contact dimple that progressively engages the male terminal. In order to produce terminals for different applications, but having the lowest insertion forces, cutouts in the terminal body section can be provided to render the contact beams more supple. The latter enables the production of cost-effective connectors with minimal mating forces.

I claim:

1. An electrical receptacle terminal stamped and formed from sheet metal comprising a rectangular shaped body section having top, bottom and sidewalls, and a pair of single resilient cantilever beams extending axially from opposed sidewalls thereof, each cantilever beam having a first protrusion proximate a complementary male contact receiving end thereof, the first protrusions spaced apart at a distance less than the thickness of a complementary mating male contact axially receivable therebetween such that the cantilever beams are resiliently biased apart during preliminary insertion of the male contact therebetween, characterized in that each cantilever beam has a second protrusion in the form of a contact dimple, the contact dimple being axially offset from the first protrusion towards the body section, whereby the contact dimples are spaced apart during preliminary insertion at a distance less than the thickness of the male contact such that during complete axial insertion of the male contact therebetween, the cantilever beams are resiliently biased further apart and electrical contact between the cantilever beams and the male contact is effectuated substantially by the contact dimples and characterized in that the top and bottom walls of the body section comprise, centrally disposed between the sidewalls, oblong cutouts extending axially therealong for adjustment of the spring force of the cantilever beams by modification of the width or length of the cutouts.

2. The terminal of claim 1 characterized in that the first protrusions comprise an arcuate contact section extending into a flared lead-in portion towards the male contact receiving end for guiding the male contact therebetween during preliminary insertion.

3. The terminal of claim 2 characterized in that the arcuate contact section and flared lead-in portion extend across substantially the whole width of the cantilever beams.

4. The terminal of claim 3 characterized in that the cantilever beams extend only from the body section sidewalls.

5. The terminal of claim 4 characterized in that the contact dimples are embossed.

6. The terminal of claim 1 characterized in that the contact between the contact dimples and the male contact is substantially a point contact.

7. The terminal of claim 6 characterized in that the contact dimple is disposed between lines defined by axially generating extremities of the first protrusions.

8. The terminal of claim 1 characterized in that at least one of the cutouts extends rearwardly from a front edge of the top or bottom wall or both.

9. The terminal of claim 1 characterized in that the sidewalls have cutouts resulting from the formation of resilient locking lances.

10. The terminal of claim 9 characterized in that the sidewall cutouts are increased in width or axial length or both, with respect to the locking lance, for adjustment of the spring force of the cantilever beams.

* * * * *